US008193135B2

(12) United States Patent
Tanaglia

(10) Patent No.: US 8,193,135 B2
(45) Date of Patent: Jun. 5, 2012

(54) ETHYLENE-PROPYLENE COPOLYMERS SUITABLE FOR THE MODIFICATION OF LUBRICATING OILS AND PROCESS FOR THE PREPARATION THEREOF

(75) Inventor: Tiziano Tanaglia, Bologna (IT)

(73) Assignee: Polimeri Europa S.p.A., San Donato Milanese (IT)

( * ) Notice: Subject to any disclaimer, the term of this patent is extended or adjusted under 35 U.S.C. 154(b) by 416 days.

(21) Appl. No.: 12/162,703

(22) PCT Filed: Feb. 12, 2007

(86) PCT No.: PCT/EP2007/001428

§ 371 (c)(1),
(2), (4) Date: Jul. 30, 2008

(87) PCT Pub. No.: WO2007/093446

PCT Pub. Date: Aug. 23, 2007

(65) Prior Publication Data

US 2009/0018041 A1 Jan. 15, 2009

(30) Foreign Application Priority Data

Feb. 16, 2006 (IT) ..... MI06A0286

(51) Int. Cl.
*C10M 143/00* (2006.01)

(52) U.S. Cl. ..... 508/591; 585/10; 585/11; 585/12

(58) Field of Classification Search ..... 508/591; 585/10, 11, 12

See application file for complete search history.

(56) References Cited

U.S. PATENT DOCUMENTS

| | | | | |
|---|---|---|---|---|
| 3,772,196 | A | 11/1973 | St. Clair et al. | |
| 5,164,455 | A * | 11/1992 | Agostinis et al. | 525/314 |
| 7,208,543 | B2 | 4/2007 | Tanaglia | |
| 2006/0135697 | A1 | 6/2006 | Tanaglia | |

FOREIGN PATENT DOCUMENTS

| | | |
|---|---|---|
| EP | 0 638 611 | 2/1995 |
| EP | 1 013 673 | 6/2000 |
| WO | 96 17041 | 6/1996 |
| WO | 2004 087849 | 10/2004 |

* cited by examiner

*Primary Examiner* — Walter D Griffin
*Assistant Examiner* — Taiwo Oladapo
(74) *Attorney, Agent, or Firm* — Oblon, Spivak, McClelland, Maier & Neustadt, L.L.P.

(57) ABSTRACT

Process for the preparation of viscosity index improver (V.I.I.) additives of lubricating oils which comprises a mixing treatment under high shear conditions of a composition comprising: (i) one or more EP(D)M polymers (ii) one or more polyvinylarene/conjugated hydrogenated polydiene/polyvinylarene block copolymers; and (iii) lubricating oil, (ii) being present in a concentration of 1.5 to 20% by weight whereas (iii) is present in a concentration ranging from 1.5 to 45% by weight.

19 Claims, 6 Drawing Sheets

ETHYLENE-PROPYLENE COPOLYMERS SUITABLE FOR THE MODIFICATION OF LUBRICATING OILS AND PROCESS FOR THE PREPARATION THEREOF

CROSS REFERENCES TO RELATED APPLICATIONS

This application is a 371 of International Patent Application No. PCT/EP07/01428, filed on Feb. 12, 2007, and claims priority to Italian Patent Application MI2006A000286, filed on Feb. 16, 2006.

The present invention relates to ethylene-propylene copolymers suitable for the modification of lubricating oils and the process for the preparation thereof.

Elastomeric copolymers and terpolymers of ethylene (hereafter indicated as EP(D)M) are widely used in the field of additives for lubricating oils (in the field indicated with the term OCP "olefin copolymer"), and their characteristics have been widely studied.

In selecting the product to be used in the field, aspects linked to the molecular weight, molecular weight distribution and ethylene content of the additive are of great importance.

The molecular weight of the polymer tends to increase the thickening capacity of the additive, i.e. the capacity of increasing the viscosity at a high temperature of the oil base. To ensure that the chains are stable under the high shear conditions of the lubricated parts of the engine, however, molecular weights are preferred, which are generally low and difficult to obtain in polymerization plants.

For this reason, it can be preferable to reduce down-stream the molecular weight of the polymer obtained under standard conditions in the polymerization plant.

OCPs are traditionally sold to oil producers in the form of a concentrated solution (from 7 to about 12%) of polymer in oil, and consequently the molecular weight reduction processes of the polymer developed in the field can be classified as follows:

- those comprising reduction of the molecular weight in solution or in mass contextual with dissolution;
- those comprising reduction of the molecular weight in mass and which put a solid OCP on the market, which can be used by simple dissolution.

The known degradation techniques in a batch masticator, in which the polymeric bases undergo a thermo-oxidative treatment and subsequent dissolution in the same reactor, belong to the first category. Other processes, well-known to experts in the field, are based on the shear degradation of standard polymers in solution. Other processes comprise a high temperature extrusion phase in which the polymer is dissolved in oil directly at the outlet of the extruder (as described in the patent U.S. Pat. No. 4,464,493).

Mass processes, prevalently in high temperature and high shear extrusion, in which the product is recovered as a solid, belong to the second category.

In this case, if the known problems relating to the handling of low molecular weight and, in most cases, completely amorphous products are overcome, the process allows an optimum productivity and also enables the OCP additive to be commercialized outside the geographical area where it was produced (jeopardizing for a concentrated solution of OCP in oil).

The process which allows the most advantageous molecular weight reduction of standard EP(D)M for obtaining solid OCPs, is the non-oxidative thermo-mechanical degradation process in extrusion, cited for example in Canadian patent 911,792.

Alternatively, it is possible to carry out the degradation process under the conditions described in Italian patent application MI98A 002774, of the Applicant, i.e. in the presence of a substance of a hydroperoxide nature under high shear conditions and at moderate temperatures with respect to traditional thermo-mechanical degradation.

It is also known that it is possible to improve the form stability of OCPs by using modest quantities of polyvinylarene/conjugated hydrogenated polydiene/polyvinylarene block copolymers.

Finally, it is possible to obtain low molecular weight products in polymerization. In this case, the products thus obtained, having the same drawbacks described above, tend to create problems in the various recovery phases of the product (stripper, extrusion, etc.). These productions are normally characterized by a low productivity and frequent running interruptions.

If solid OCPs have advantages in terms of productivity and logistic costs, they require, however, a dissolution process which is anything but simple.

However low the molecular weight may be, the dissolution plant requires high temperatures (100-160°C.) and high dissolution times which vary from 3 to 7 hours. Dissolution plants are also characterized by precise and distinctive features which relate to the stirring systems, the temperature ranges and other characteristics (differing from technology to technology) making it necessary to have an appropriate dissolver for the specific processing.

Traditionally stirred recipients used for producing, by dilution and mixing of the various components and additives, the final formulation of oil and other oil specialties, are certainly not suitable for treating solid OCPs.

It is somehow logical to believe that, even if there is no known solid OCP containing a minority quantity of oil, in general the dissolution of polymers containing oil can be facilitated and, in relation to the quantity of oil, can arrive at not requiring specific but only possibly modified dissolution plants.

Producing low molecular weight copolymers such as OCPs containing oil, however, is not at all easy, and if the product were to be amorphous, there would obviously be greater critical aspects.

In the first place, as the presence of oil makes the polymer shear less effective as a result of the viscosity drop due to the presence of oil, this would negatively interfere with the thermo-mechanical degradation process; this difficulty could be more or less observed in relation to the quantity of oil used and the capacity of the extrusion plant of increasing the shear rate of the process.

Secondly, and this is much more important, the end-product, i.e. an oil-extended low molecular weight OCP, would have a somewhat reduced dimensional stability and, in any case, much worse that the product obtained in the absence of oil which, above all if amorphous, would however create problems in the recovery of the granules.

In other words, the presence of oil in the OCP would complicate the recovery of the product downstream the extruder in a phase which is in any case critical.

It has now been surprisingly found that by applying the method which envisages the use of small quantities of polyvinylarene/conjugated hydrogenated polydiene/polyvinylarene block copolymers combined with ethylenepropylene (or ethylene-propylene-diene) copolymers, it is possible to obtain oil-extended OCPs overcoming the critical aspects and drawbacks mentioned above.

It has in fact been surprisingly found that, contrary to a normal OCP in which the addition of oil produces a strong reduction in the form stability, in the case of an OCP in which there is the presence of polyvinylarene/conjugated hydrogenated polydiene/polyvinylarene block copolymers, the addition of oil allows OCPs to be obtained, having an identical form stability or only slightly reduced but in any case higher than what could logically be expected on the basis of what can be observed with the EP(D)M+oil system, above all on the basis of the reduction in total concentration of the block copolymer which the use of oil would necessarily cause.

As the addition of oil, in fact, cannot alter the ratio between EP(D)M and block copolymer (established by various parameter such as the properties and cost of the additive) it would necessarily cause a reduction in the total concentration of the block copolymer itself.

It has been surprisingly found, however, that neither the dilution effect of the block copolymer nor the increase in fluidity deriving from the use of oil are effective in significantly reducing the form stability of the final oil-extended OCP. It has even been found that, within a narrower oil concentration range, an unexpected improvement in the form stability of the additive is obtained with respect to the analogous non-oil-extended product.

It has also been surprisingly found that at a high shear rate and in the presence of a substance of a hydroperoxide nature, the effect of oil on the degradation process increases or does not reduce the efficacy thereof. On the contrary, the presence of oil distinctly reduces the efficacy of the simple thermodegradation process in extrusion.

Figure 1:
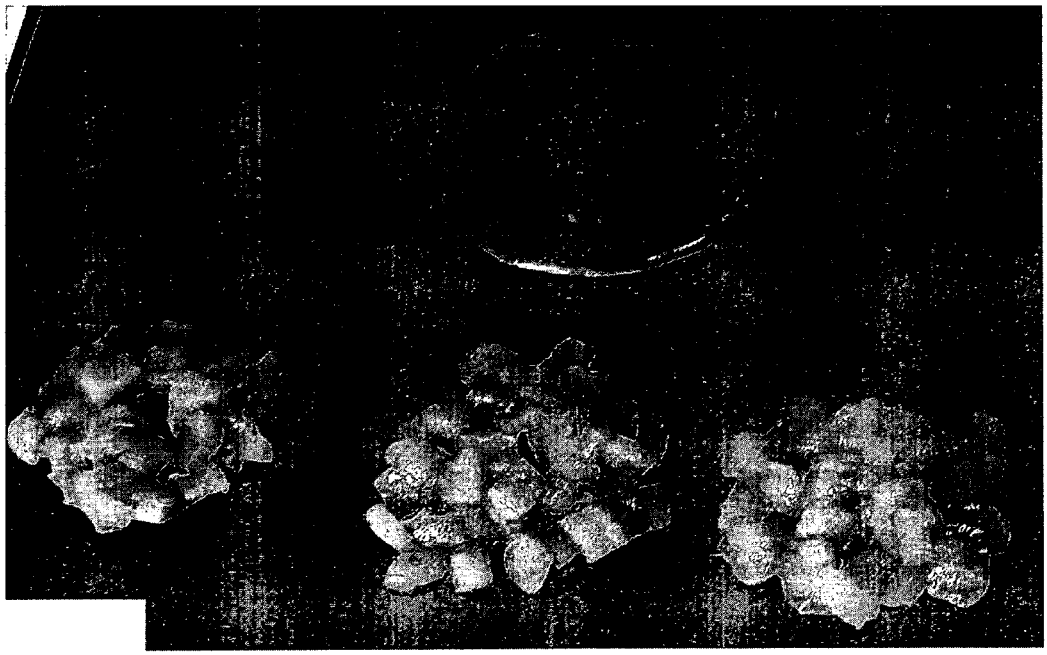
FIG. 1 shows the result of the tests obtained in Examples 2*c*, 4 and 3*c*.

In accordance with this, the present invention relates to a process for the preparation of viscosity index improvers (V.I.I.) of lubricating oils which comprises a mixing treatment under high shear conditions of a composition comprising (i) one or more EP(D)M polymers, (ii) one or more polyvinylarene/hydrogenated conjugated polydiene/polyvinylarene block copolymers and (iii) lubricating oil, (ii) being preferably present in a concentration of 1.5 to 20% by weight, most preferably from 3 to 9%, whereas (iii) is present in a concentration ranging preferably from 1.5 to 45% by weight, most preferably from 3 to 25%. The above process is carried out at a temperature preferably ranging from 150° C. to 400° C., most preferably from 180° C. to 320° C.

The oil which can be used according to the present invention is preferably mineral oil for economic reasons. The use of synthetic oil bases however is not excluded.

Among mineral oil bases, those preferred are paraffinic with a closed cup flash point preferably higher than 150° C., most preferably equal to or higher than 200° C.

The term "high shear" refers preferably to a shear rate higher than 50 $sec^{-1}$, most preferably higher than 400 $sec^{-1}$.

The oil is preferably fed after being absorbed on the block copolymer and used with block copolymer/oil ratios which vary from 1 to 5.

The process is preferably carried out in the presence of a substance of a hydroperoxide nature, in this case, the temperature of the high shear areas must not exceed 260° C. The substance of a hydroperoxide nature is used in a concentration ranging from 0 to 8%, preferably from 0.15 to 1%.

Among substances of a hydroperoxide nature, the preferred are: ter-butyl hydroperoxide, isoamyl hydroperoxide, cumyl hydroperoxide, isopropyl hydroperoxide.

The process of the present invention can preferably be carried out using common transformation machines of polymeric materials which allow the shear rates indicated above, for example an extruder in continuous or, preferably, a twin-screw extruder or extruder of the ko-kneter type. The extrusion plant generally consists of a feeding zone in which gravimetric or volumetric batchers dose the various components and sent them to the inlet of the extruder.

The extruder, single-screw, twin-screw (co- or counter-rotating), ko-kneter, heats and sends the granules of the products fed towards a mixing area. The combined effect of the temperature, mixing and compression on the product leads to the plasticization of the various polymeric bases and, by continuing and/or intensifying the process, to close mixing and degradation. The duration of the process does not exceed 150 seconds, preferably 90 seconds, otherwise causing the uncontrolled degradation of the materials fed.

In the simplest embodiment of the present invention, to which the experimental examples refer, the block copolymer and oil are contextually fed to the EP(D)M polymeric base, it is possible however to feed the block copolymer and oil to a separate area of the extruder following the feeding of the EP(D)M base, sufficient however for guaranteeing a close mixing.

The term EP(D)M refers to both EPM (ethylene-propylene) copolymers and EPDM (ethylene-propylene-non-conjugated diene terpolymers), wherein the weight content of ethylene ranges preferably from 85 to 40%, most preferably from 76% to 45%. The possible non-conjugated diene is preferably present in a maximum quantity of 12% by weight, most preferably 5% by weight, and even more preferably zero. EP(D)M polymers preferably have the following properties:

- Weight average molecular weight ($M_w$) preferably from 70,000 to 500,000, most preferably from 90,000 to 450,000;
- Polydispersity expressed as $M_w/M_n$ preferably lower than 5, most preferably from 1.8 to 4.9;
- Ratio between Melt Index flow at a weight of 21.6 kg and Melt Index flow at a weight of 2.16 kg, both at a temperature of 230° C., ranging preferably from 18 to 60, most preferably from 20 to 40.

The molecular weight $M_w$ is measured via GPC with a diffraction index detector.

In the case of EPDM, the diene is preferablyselected from:

- linear-chain dienes, such as 1,4-hexadiene and 1,6-octadiene;
- branched-chain acyclic dienes, such as 5-methyl-1,4-hexadiene; 3,7-dimethyl-1,6-octadiene; 3,7-dimethyl-1,7-octadiene;
- single-ring alicyclic dienes, such as 1,4-cyclo hexadiene; 1,5-cyclo-octadiene; 1,5-cyclododecadiene;
- dienes having condensed and bridged alicyclic rings, such as methyltetrahydroindene; dicyclopentadiene; bicyclo

[2.2.1]hepta-2,5-diene; $C_1$-$C_8$-alkenyl, $C_2$-$C_8$-alkylidene, $C_3$-$C_{12}$-cyclo-alkenyl and $C_3$-$C_{12}$-cyclo-alkylidene norbornenes such as 5-methylene-2-norbornene; 5-ethylidene-2-norbornene (ENB); 5-propenyl-2-norbornene.

In the preferred embodiment the diene is 5-ethylidene-2-norbornene (ENB).

The process of the present invention is applied to both amorphous and semi-crystalline EP(D)M polymers and relative mixtures, preferably mixtures of crystalline EPM with amorphous EPM polymers or to amorphous EPM polymers. It should be remembered that amorphous EP(D)M polymers have an ethylene content ranging preferably from 62% to 40% by weight, most preferably from 55% to 45% by weight. Semicrystalline EP(D)M, on the other hand, is characterized by an ethylene content by weight ranging preferably from 85% to 63% by weight, most preferably from 76% to 68% by weight.

The molecular weight of EP(D)M in the feeding to the process, object of the present invention, does not represent a critical aspect. It is preferable however to have a weight average molecular weight higher than 150,000 to avoid problems in the feeding of the extruder. Exceeding a molecular weight of 250,000, however, is not advisable to avoid excessive energy consumption and reach the maximum acceptable couple for the extruder motor.

The component indicated as hydrogenated block copolymer is characterized by a block structure in which polyvinylarene chains, preferably polystyrene, are alternated with hydrogenated conjugated polydiolefinic chains.

Typically obtained by stepped anionic catalysis, block copolymers have structures well-known to experts in the field. They consist of a "soft" part and a "hard" part. The soft part is preferably selected from hydrogenated polybutadiene, hydrogenated polyisoprene, and the hydrogenated isoprene-butadiene copolymer.

The hard part, on the other hand consists of sections of polyvinylarene chain.

In the preferred embodiment, the block copolymer is selected from SEBS, i.e. styrene/ethylene-butene/styrene block copolymers.

The hydrogenated block copolymer which can be used in the process of the present invention has a vinylaromatic content, preferably styrene, ranging preferably from 15 to 50% by weight. The same product therefore has from 85 to 50% by weight of hydrogenated conjugated diolefin units, the above hydrogenated conjugated diolefin units being selected from butadiene, isoprene, butadiene-isoprene copolymer, and relative mixtures. In the case of butadiene, preferably at least 20% with 1,2 concatenation.

The molecular weight of the hydrogenated block copolymer ranges preferably from 45,000 to 250,000, most preferably from 50,000 to 200,000.

The ratio between EP(D)M polymer and block copolymer can range preferably from 98:2 to 80:20, due to the cost of hydrogenated block copolymers, however, it is most preferable to maintain a ratio of 97:3 to 90:10.

These low quantities of hydrogenated block copolymer can also be advantageous due to the fact that, as they do not enter the final formulation in sufficient quantities for influencing the performances, the selection of the most economical product and with the best characteristics from the point of view of form stability, becomes much wider.

The process of the present invention therefore allows an OCP additive to be obtained, characterized in that it is oil-extended and also has a sufficient form stability to enable the use of normal finishing machines for plastic materials and it also allows the recovery of the product.

The invention therefore consists in a transformation process in which the ethylene copolymer or terpolymer, mixed with hydrogenated block copolymers and oil, is subjected to treatment for reducing the molecular weight under high shear and high temperature conditions.

It is also possible and preferable to carry out the degradation process under the conditions described in Italian patent application MI98A 002774, to the same Applicant, i.e. in the presence of a substance of a hydroperoxide nature under high shear conditions and at moderate temperatures with respect to traditional thermodegradation, thus obtaining a high degradation efficiency so as to overcome the above-mentioned problems linked to the lowering of the degradation efficiency of the traditional thermo-mechanical process in the presence of oil.

Finally, it is possible to carry out the degradation process in the presence of a substance of a hydroperoxide nature under high shear conditions and regulating the branching degree by the dosage of a polyfunctional vinyl monomer.

In a further optional embodiment of the present invention, the process of the present invention can be carried out within the finishing phase of the production process of the generating polymeric base. In this case, all or, preferably, a part of the polymer in the finishing phase (before the final forming) is removed from the standard flow and sent to the transformation machine selected for the process object of the invention.

The following examples are provided for a better understanding of the present invention for illustrative and non-limiting purposes only.

EXAMPLES

Material

Dutral® CO058 ethylene-propylene copolymer—Polimeri Europa
- 48% wt of propylene
- ML (1+4) at 100° C.=78
- MFI (L)=0.6
- MFI (E)=0.3

Europrene® SOL TH 2315 SEBS copolymer—Polimeri Europa
- 30% wt of styrene
- Mw=170,000
- 40% butadiene 1-2 concatenation (vinyl)

Paraffinic oil OBI 10 lubricating oil Agip
- Flash point=215° C. in closed cup

Kinematic viscosity=62.5 cSt at 40° C.

All the examples are carried out using a co-rotating twin-screw extruder of the Maris TM35V type, with a screw profile and rotation rate such as to have a shear rate of approximately 1,000 $sec^{-1}$ and a process time of about 1 minute (60 seconds).

Comparative Example 1

The following polymeric base was fed to a Maris TM 35V twin-screw extruder, L/D=32, maximum temperature 275° C., RPM=275:

100% of C0O58

A product was recovered, which was subsequently massed in an open mixer at 130° C.".

A melt flow index analysis was effected on this product with a weight of 2.16 kg at temperatures of 190° C. (E) and 230° C. (L).

MFI (E)=6.0 g/10'

MFI (L)=11.4 g/10'

Comparative Example 2

The following polymeric base was fed to a Maris TM 35V twin-screw extruder, L/D=32, maximum temperature 265° C., RPM=275:

96% of C0O58

4% of SOLTH 2315

A product was recovered, which was subsequently massed in an open mixer at 130° C.

A melt flow index analysis was effected on this product with a weight of 2.16 kg at temperatures of 190° C. (E) and 230° C. (L).

MFI (E)=6.0 g/10'

MFI (L)=11.8 g/10'

Comparative Example 3

The following polymeric base was fed to a Maris TM 35V twin-screw extruder, L/D=32, maximum temperature 270° C., RPM=275:

96.4% of C0O58

3.6% of SOLTH 2315

A product was recovered, which was subsequently massed in an open mixer at 130° C.

A melt flow index analysis was effected on this product with a weight of 2.16 kg at temperatures of 190° C. (E) and 230° C. (L).

MFI (E)=7.0 g/10'

MFI (L)=13.9 g/10'

Example 4

The following polymeric base was fed to a Maris TM 35V twin-screw extruder, L/D=32, maximum temperature 260° C., RPM=275:

86.4% of C0058

3.6% of SOLTH 2315

10% of white paraffinic oil OBI 10

(the ratio between SEBS and C0058 remains identical to that of comparative example 1)

A product was recovered, which was subsequently massed in an open mixer at 130° C.

A melt flow index analysis was effected on this product with a weight of 2.16 kg at temperatures of 190° C. (E) and 230° C. (L).

MFI (E)=7.1 g/10'

MFI (L)=14.3 g/10'

By adding 10% of oil on different products (5), having the same composition as Example 1, a calibration line was created, which allowed the MFI(E) of the polymeric part of Example 2 to be extrapolated.

MFI (E)=6.1 (extrapolated)

Upon analyzing compositions and melt flow indexes of comparative examples 1 to 3, the following can be observed:

In comparative Example 1, an amorphous OCP without the presence of SEBS having the same MFI as the polymeric part of the product of Example 4.

In comparative example 2, an amorphous OCP with the same concentration of SEBS and the same MFI as the polymeric part of the product of Example 4.

In comparative example 3, an amorphous OCP with the same total concentration of SEBS and the same MFI as the product of Example 4.

It would be certainly legitimate to expect that the effect of the oil would tend to considerably reduce the form stability of the product due to the effect of the fluidity induced by the oil and also to the dilution of the SEBS.

It can therefore be expected for the product of Example 4 to clearly diverge from that of comparative Example 2 and to be in first approximation analogous to that of comparative Example 3.

Furthermore it cannot be excluded that the product, due to the effect of 10% of oil, could annul the effect of the 4% of SEBS.

Various cubes with a side of about 0.5 cm were cut from each calendered sample of examples 1c (c=comparative) to 4 and were then stacked so as to form a pyramid-shaped pile. The stacks of cubes were then left at room temperature for a week.

The result of the tests is illustrated in the photo of FIG. 1, in which the three stacks in the front are those of Examples 2c, 4 and 3c, whereas what remains of the stack of Example 1c is situated behind.

It is completely demonstrated that the effect of the oil does not annul that of the SEBS.

Figure 2:
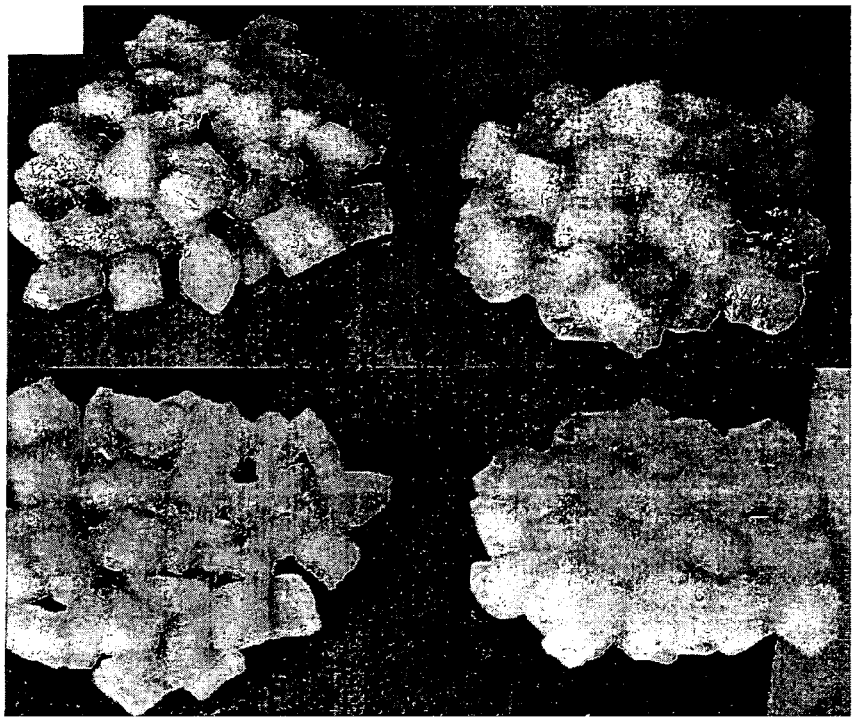
FIG. 2 shows results that compare the stacks obtained with the products of Examples 4 (on the left) and 3*c* (on the right).

FIG. 2 compares the stacks obtained with the products of Examples 4 (on the left) and 3c (on the right). The photos in the upper part of the figure relate to the upper part of the stacks, whereas the photos in the lower part of the figure relate to the overturned stack.

It can be observed without difficulty and the possibility of error that even if the product of the invention has the same fluidity (apparent molecular weight) it shows a distinct improvement in the form stability.

Figure 3:
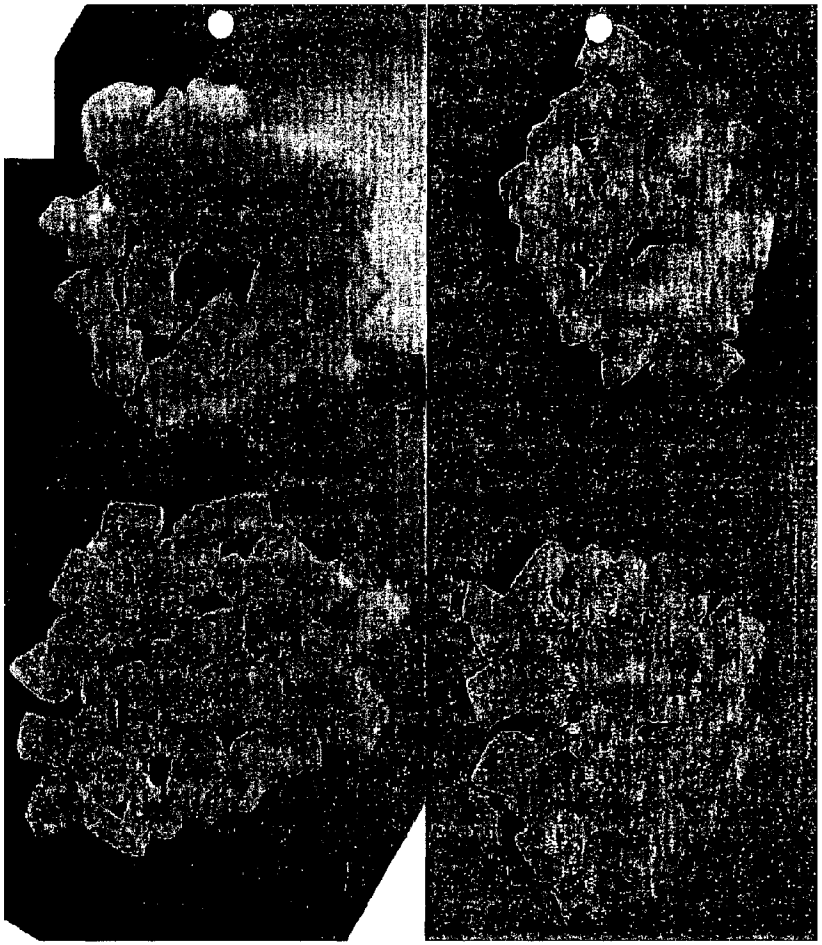
FIG. 3 shows results that compare the stacks of products of Example 2*c* (on the left) and Example 4 (on the right).

FIG. 3, on the other hand, compares the stacks of products of Example 2c (on the left) and Example 4 (on the right). In spite of the different concentration of SEBS and the different fluidity (MFI) (which, for example, make the product of Example 2c much more stable than that of Example 3c), the two products do not show evident differences in form stability, and however not as evident as those among the examples shown in FIG. 2.

In order to confirm these observations, frequency scan dynamic-mechanical tests (DMA) were carried out at a temperature of 40° C. from $3*10^{-3}$ to 100 rad/s.

Figure 4:
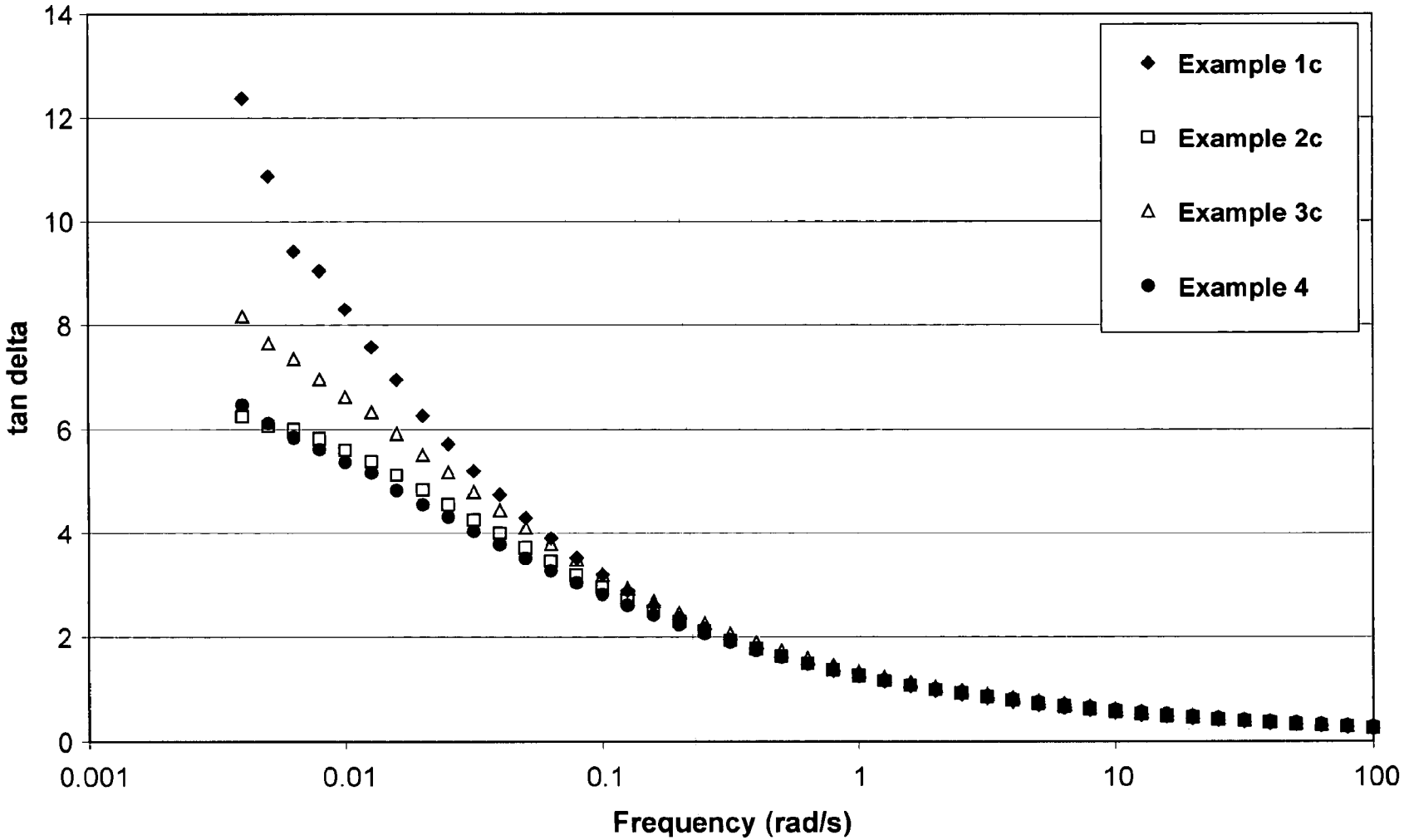
FIG. 4. shows the tan δ trend with the frequency of the products of Examples 1*c* to 4.

The tan δ trend with the frequency of the products of Examples 1c to 4 are shown in FIG. 4. The observations made on the piles of particles are confirmed, as also the great difference between the product of Example 3c and the product of Example 4 which does not distinctly diverge from that of Example 2c.

The most evident aspect of these data is that relating to the effect of the SEBS concentration. As expected, by bringing the SEBS content from 4 to 3.6%, the form stability undergoes a distinct deterioration (as is evident from a comparison between Example 2c and 3c and which can also be assumed from a comparison between Example 1c and 2c).

By passing, on the contrary, from 4% to 3.6% of SEBS with the addition of oil (10%), this deterioration in form stability is not observed, or at least is much less evident.

Examples 5-7 suitably show that with a high shear rate and in the presence of a substance of a hydroperoxide nature, the effect of the oil on the degradation process increases, or however does not reduce its efficacy. On the contrary, the presence of oil considerably reduces the efficacy of the simple thermodegradation process in extrusion.

It may therefore be advisable to use this degradation method for producing oil-extended OCP having a particularly low molecular weight.

Comparative Example 5

The following polymeric base was fed to a Maris TM 35V twin-screw extruder, L/D=32, using the same thermal profile as Example 4, at a maximum temperature of 260° C., RPM=275:

96% of C0O58

4% of SOLTH 2315

A product was recovered, which was subsequently massed in an open mixer at 130° C.

A melt flow index analysis was effected on this product with a weight of 2.16 kg at temperatures of 190° C. (E) and 230° C. (L).

MFI (E)=8.1 g/10'

MFI (L)=16.7 g/10'

It is demonstrated that the effect of the oil on the degradation reduces the efficacy.

Comparative Example 6

The following polymeric base was fed to a Maris TM 35V twin-screw extruder, L/D=32, maximum temperature 200° C., RPM=275:

96 parts of C0O58

4 parts of SOLTH 2315

0.9 parts of TBHP 70% in aqueous solution

A product was recovered, which was subsequently massed in an open mixer at 130° C.

A melt flow index analysis was effected on this product with a weight of 2.16 kg at temperatures of 190° C. (E).

MFI (E)=7.5 g/10'

Example 7

The following polymeric base was fed to a Maris TM 35V twin-screw extruder, L/D=32, using the same thermal profile as Example 6c, at a maximum temperature of 200° C., RPM=275:

86.4 parts of C0O58

3.6 parts of SOLTH 2315

10 parts of white paraffinic oil OBI 10

0.9 parts of TBHP 70% in aqueous solution

A product was recovered, which was subsequently massed in an open mixer at 130° C.

A melt flow index analysis was effected on this product with a weight of 2.16 kg at temperatures of 190° C. (E).

MFI (E)=10.2 g/10'

MFI (E)=8.0 (extrapolated)

It is demonstrated that, even if the effect of the oil on the traditional degradation could reduce the efficacy, by using the technology which envisages the use of hydroperoxide, in addition to obtaining the known efficacy (degradation takes place at 200° C. rather than 260° C.) the effect of the presence of oil in the degradation process is annulled or rather, is inverted.

Comparative Example 8

180 g of the product of Comparative example 2 were plasticized in an open mixer having thermostat-regulated rolls at 130° C. and at a distance of 1.4 mm, 20 g of paraffinic oil OBI 10 were then fed. The mixing was continued for 12 minutes (according to a well consolidated mixing technique) plasticizing the product on the surface of the roll, and cutting and reinserting it between the rolls for at least 12 times in order to perfect the mixing.

A melt flow index analysis was effected on the product thus obtained, with a weight of 2.16 kg at temperatures of 190° C. (E).

MFI (E)=6.9 g/10'

This product can be easily compared with Example 4 of the invention and comparative Example 3.

A frequency scan dynamic-mechanical test (DMA) was carried out at a temperature of 40° C. from $3*10^{-3}$ to 100 rad/s.

Figure 5:
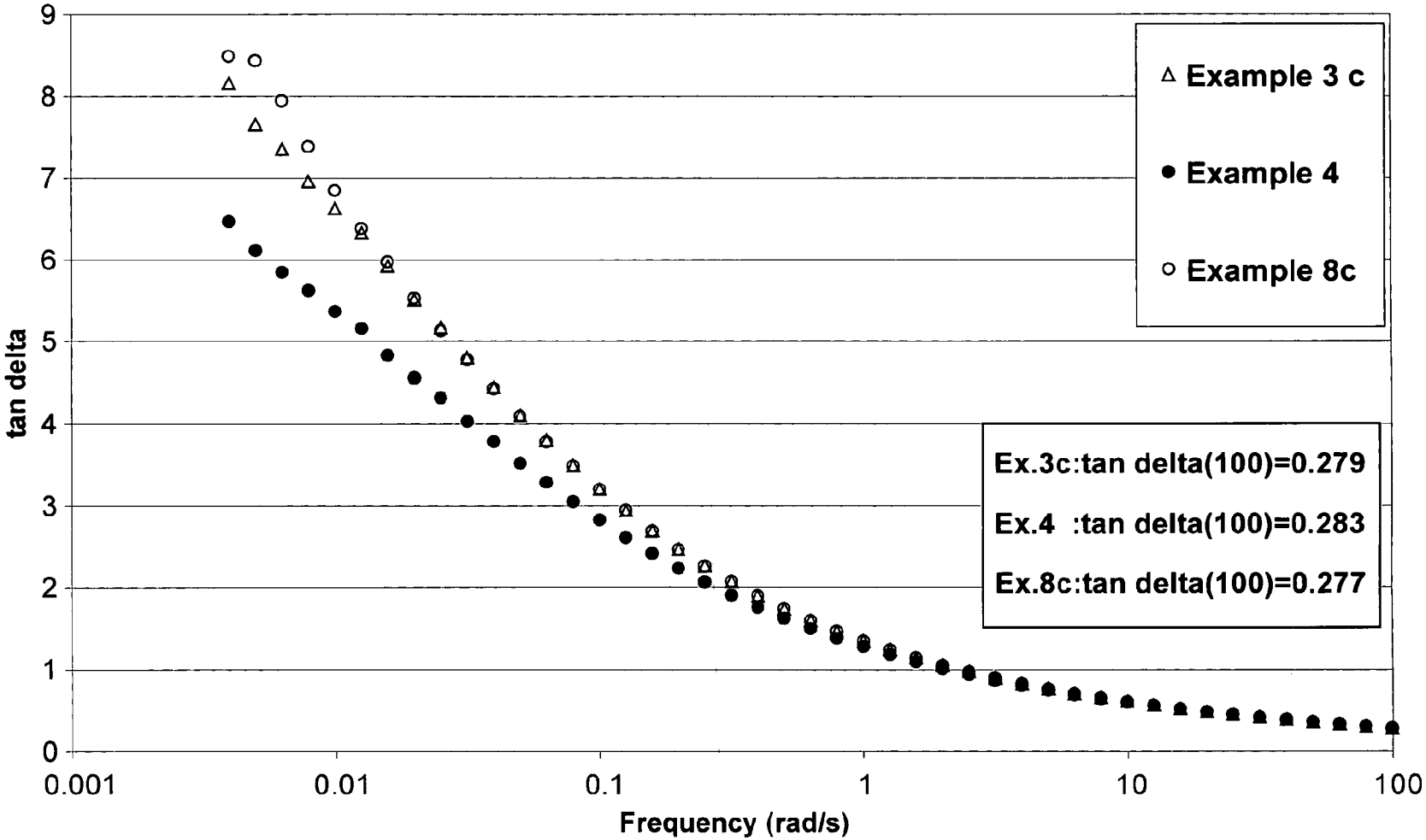
FIG. 5 shows the tan δ trend with the frequency of the product of Example 8*c* compared with those of Examples 3*c* and 4.

The tan δ trend with the frequency of the product of Example 8c compared with those of Examples 3c and 4 are shown in FIG. 5.

It is surprisingly verified that simple mixing of the oil with the product previously obtained by degradation of EPM+SEBS does not have the same dimensional stability as that obtained by the contextual degradation of SEBS+EPM+oil (in the concentrations indicated in the claims).

On the contrary, the product of Example 8c proves to be similar to the product of comparative Example 3 characterized by the same fluidity (MFI) and the same total concentration of SEBS.

From the data thus obtained, it seems extremely likely at the moment that the method, object of the present invention, can even increase (for oil contents lower than 10%) the form stability of the product obtained with the same molecular weight and EPM/SEBS ratio.

Example 9

The following polymeric base was fed to a Maris TM 35V twin-screw extruder, L/D=32, at a maximum temperature of 265° C., RPM=275:

90.1 parts of C0O58

3.3 parts of SOLTH 2315

6.6 parts of white paraffinic oil OBI 10

A product was recovered, which was subsequently massed in an open mixer at 130° C.

A melt flow index analysis was effected on this product with a weight of 2.16 kg at temperatures of 190° C. (E).

MFI (E)=6.9 g/10'

MFI (E)=6.5 (extrapolated)

Example 10

The following polymeric base was fed to a Maris TM 35V twin-screw extruder, L/D=32, at a maximum temperature of 275° C., RPM=275:

90.1 parts of C0O58

3.3 parts of SOLTH 2315

6.6 parts of white paraffinic oil OBI 10

A product was recovered, which was subsequently massed in an open mixer at 130° C.

A melt flow index analysis was effected on this product with a weight of 2.16 kg at temperatures of 190° C. (E).

MFI (E)=8.5 g/10'

MFI (E)=7.4 (extrapolated)

Example 11

The following polymeric base was fed to a Maris TM 35V twin-screw extruder, L/D=32, at a maximum temperature of 270° C., RPM=275:

92.5 parts of C0O58

3.4 parts of SOLTH 2315

5.1 parts of white paraffinic oil OBI 10

A product was recovered, which was subsequently massed in an open mixer at 130° C.

A melt flow index analysis was effected on this product with a weight of 2.16 kg at temperatures of 190° C. (E).

MFI (E)=7.9 g/10'

MFI (E)=7.2 (extrapolated)

The products of Examples 9, 10 and 11 are characterized by a SEBS content (with respect to the total polymer) analogous or slightly lower than that of comparative Example 3 (3.6% of SEBS).

The products of comparative Examples 9 and 10 are characterized by a SEBS content of 3.53% with respect to the total polymer whereas the product of Example 11 has 3.58% of SEBS with respect to the total polymer.

Form stability tests were carried out, completely analogous to those shown in FIGS. 1-3, which indicate an analogous behaviour for the products of Examples 9-11.

Apart from the non-evident differences in fluidity (melt index), they did in fact all have a very similar SEBS content both as absolute value and as a ratio with respect to the polymer.

Figure 6:
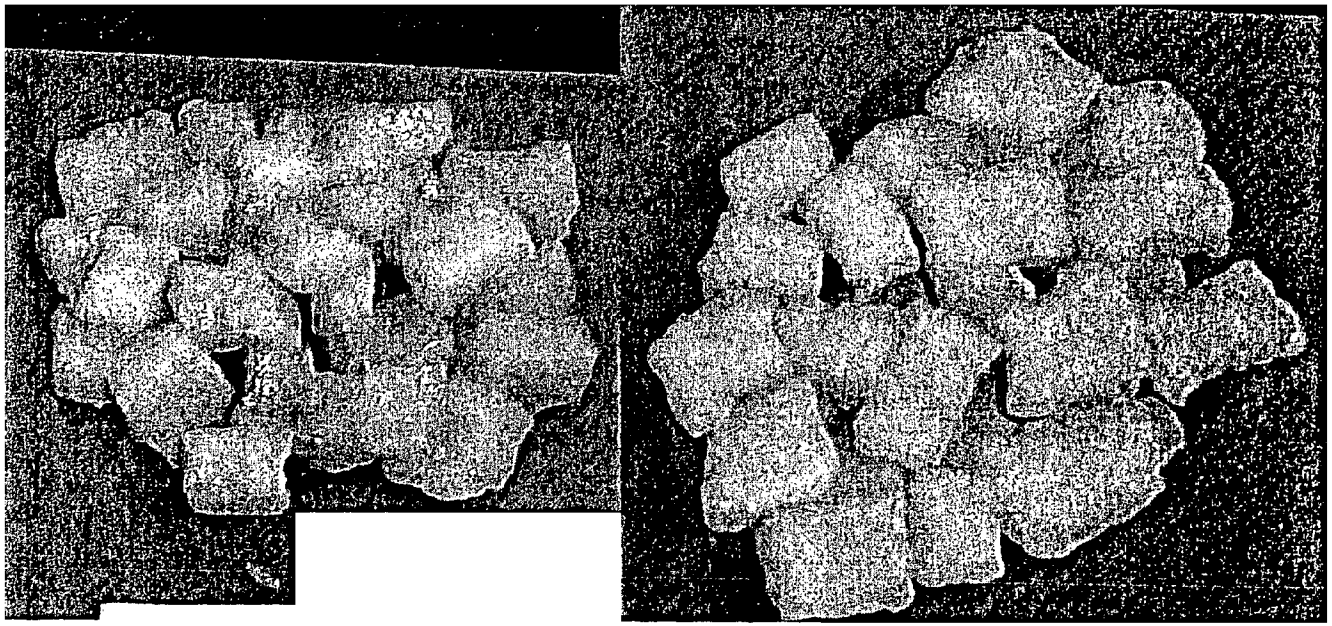
FIG. 6 shows the photographs of the stack formed with the product of Example 9 in both the upper part (left) and lower part (right).

These products have a much better form stability with respect to that of comparative Example 3 as shown in FIG. 6 for the product of Example 9.

FIG. 6, in fact, shows the photographs of the stack formed with the product of Example 9 in both the upper part (left) and lower part (right). It can be clearly assumed that the product of Example 9, and therefore also of Examples 10 and 11, has a better form stability with respect to the comparative example as is quite evident by comparing these images of the stack relating to the product of comparative Example 3 shown in FIGS. 1 and 2.

It is therefore demonstrated that the use of oil combined with SEBS not only allows a sufficient dimensional stability of the oil-extended product to be maintained, which, thanks to the presence of oil, can be dissolved in less time or under less desperate temperature or stirring conditions, but for more limited concentrations of oil, it can even improve the form stability of the product with the same SEBS content (with respect to the polymer) and fluidity.

The method relating to the present invention can therefore allow oil-extended products to be obtained with an extremely low molecular weight characterized by a form stability which in any case is sufficient for being processed in the finishing line of the extrusion plant. Within a more limited range of oil (up to a ratio of about 2.5 between oil and SEBS) an improvement in the dimensional stability of the oil-extended end-product is obtained with respect to the reference.

By lowering the percentage of oil with respect to the polymer the advantages in the dissolution of the product are naturally limited (but not annulled), however the form stability thereof increases improving it with respect to the corresponding non-oil-extended product.

Evaluation as V.I.I. Additive (Viscosity Index Improver)

The products of Examples 4 and 10 were dissolved in reference oil SN 150 containing 0.3% of PPD (Pour Point Depressant) additive, in order to evaluate the low temperature properties. The SN 150 oil base has the following characteristics:

Kinematic viscosity KV 100° C.=5.3 cSt

Fix Point=−36.5° C. (Pour Point=−36°c).

"Fix Point" refers to the freezing point determined by means of an automatic temperature scan instrument. The Pour Point is equal to the Fix Point but approximated to three degrees higher.

For illustrative purposes, a commercial amorphous product (polymer A) was tested, having a molecular weight extremely similar to that of the product of Example 10, indicated as product A.

| | Fix Point ° C. | KV 100° C. cSt | Viscosity Index |
|---|---|---|---|
| Ref. Base oil | −36.5 | 5.3 | 98 |
| Sol. 1.0% Example 4 | −36.2 | 10.2 | 139 |

-continued

| | Fix Point ° C. | KV 100° C. cSt | Viscosity Index |
|---|---|---|---|
| Sol. 1.0% Example 10 | −36.3 | 9.6 | 136 |
| Sol. 1.0% product A | −36.0 | 9.5 | 135 |
| Sol. 1.8% Example 4 | −35.7 | 17.1 | |
| Sol. 1.8% Example 10 | −35.9 | 15.5 | |

The concentrations of the product of Examples 10 and 4 are intended as being expressed as weight concentrations of polymer (active part): the oil OBI 10 is therefore excluded from the calculation of the additive (for example the 1.8% solution of polymer of Example 4 in oil was prepared by dissolution of 2% of the product of Example 4).

From the comparative data, it can be deduced that the product obtained according to the present invention can be used as V.I.I. additive in the lubricating oil sector without particular counterindications, having low temperature properties however in line with amorphous products (pour point absolutely similar to the base oil containing PPD, i.e. no interference): this observation also being valid when the concentration of polymer in oil is considerably increased (1.8%).

This experimental value confirms that, by introducing small quantities of copolymer of the SEBS type and paraffinic oil, there are no evident counterindications on the final application.

The invention claimed is:

1. A process for the preparation of a viscosity index improver (V.I.I.) of lubricating oil which comprises a mixing treatment under high shear conditions of a composition comprising:

(i) one or more EPM polymers; one or more EPDM polymers; or a mixture of one or more EPM polymers and one or more EPDM polymers;

(ii) one or more polyvinylarene/conjugated hydrogenated polydiene/polyvinylarene block copolymers consisting of a styrene/ethylene-butene/styrene (SEBS) copolymer; and (iii) lubricating oil, in which (ii) is present in a concentration of 1.5 to 20% by weight and (iii) is present in a concentration ranging from 1.5 to 45% by weight.

2. The process according to claim 1, wherein the concentration of component (ii) ranges from 3 to 9%, and the concentration of component (iii) ranges from 3 to 25%.

3. The process according to claim 1, wherein the high shear treatment is effected at a temperature ranging from 150° C. to 400° C.

4. The process according to claim 1, wherein the mixing treatment is effected under shear rate higher than 50 $sec^{-1}$.

5. The process according to claim 1, wherein the oil is fed after being absorbed on the block copolymer.

6. The process according to claim 1, wherein the mixing treatment is effected at a block copolymer/oil ratio ranging from 1 to 5.

7. The process according to claim 1, wherein the mixing treatment is carried out in the presence of a substance of a hydroperoxide nature.

8. The process according to claim 7, wherein the temperature in the high shear area is lower than 260° C.

9. The process according to claim 7, wherein the substance of a hydroperoxide nature is used in a concentration ranging from 0 to 8%.

10. The process according to claim 1, wherein the hydrogenated block copolymer is characterized by a block structure in which polyvinylarene chains, are alternated with hydrogenated conjugated polydiolefinic chains.

11. The process according to claim 1, wherein the hydrogenated block copolymer has a vinylaromatic content ranging from 15 to 50% by weight and a content of hydrogenated conjugated diolefinic units ranging from 85 to 50% by weight.

12. The process according to claim 1, wherein the hydrogenated conjugated diolefinic units are derived from butadiene, isoprene, butadiene-isoprene copolymer, and relative mixtures.

13. The process according to claim 1, wherein the molecular weight of the hydrogenated block copolymer ranges from 45,000 to 250,000.

14. The process according to claim 1, wherein the ratio between said (i) one or more EPM polymers; one or more EPDM polymers; or mixture of one or more EPM polymers and one or more EPDM polymers; and said (ii) one or more polyvinylarene/conjugated hydrogenated polydiene/polyvinylarene block copolymers ranges from 98:2 to 80:20.

15. A viscosity index improver additive (V.I.I.) of lubricating oil which is obtained by a process according to claim 1.

16. A method of improving the viscosity index of a lubricating oil, comprising adding a viscosity index improver additive according to claim 15 to a lubricating oil, in a quantity ranging from 0.2 to 5% by weight, expressed as a sum of said (i) one or more EPM polymers; one or more EPDM polymers; or mixture of one or more EPM polymers and one or more EPDM polymers; plus said (ii) one or more polyvinylarene/conjugated hydrogenated polydiene/polyvinylarene block copolymers with respect to the total of the final formulation of said lubricating oil.

17. The process according to claim 7, wherein the substance of a hydroperoxide nature is used in a concentration ranging from 0.15 to 1%.

18. The process according to claim 1, wherein the molecular weight of the hydrogenated block copolymer ranges from 50,000 to 200,000.

19. A viscosity index improver (V.I.I.) of lubricating oil which comprises:

(i) one or more EPM polymers; one or more EPDM polymers; or a mixture of one or more EPM polymers and one or more EPDM polymers;

(ii) one or more polyvinylarene/conjugated hydrogenated polydiene/polyvinylarene block copolymers consisting of a styrene/ethylene-butene/styrene (SEBS) copolymer; and (iii) lubricating oil, in which (ii) is present in a concentration of 1.5 to 20% by weight and (iii) is present in a concentration ranging from 1.5 to 45% by weight.

* * * * *